US006029030A

United States Patent [19]

Yamaji et al.

[11] Patent Number: 6,029,030

[45] Date of Patent: Feb. 22, 2000

[54] DEVELOPING APPARATUS WITH MAGNETIC SEAL

[75] Inventors: Masaaki Yamaji, Yokohama; Toshiyuki Karakama, Shizuoka-ken, both of Japan

[73] Assignee: Canon Kabushiki Kaisha, Tokyo, Japan

[21] Appl. No.: 09/179,578

[22] Filed: Oct. 27, 1998

[30] Foreign Application Priority Data

Oct. 29, 1997 [JP] Japan ..... 9-296984

[51] Int. Cl.[7] ..... G03G 15/08

[52] U.S. Cl. ..... 399/104

[58] Field of Search ..... 399/103, 104, 399/267, 274, 275; 277/410, 629

[56] References Cited

U.S. PATENT DOCUMENTS

| | | | |
|---|---|---|---|
| 4,213,617 | 7/1980 | Salger | 277/12 |
| 5,790,923 | 8/1998 | Oguma et al. | 399/106 |
| 5,812,909 | 9/1998 | Oguma et al. | 399/103 |

FOREIGN PATENT DOCUMENTS

| | | |
|---|---|---|
| 0789286 | 8/1997 | European Pat. Off. . |
| 0821288 | 1/1998 | European Pat. Off. . |
| 0822465 | 2/1998 | European Pat. Off. . |
| 58-174971 | 10/1983 | Japan . |
| 3-013977 | 1/1991 | Japan . |
| 4-069691 | 3/1992 | Japan . |
| 4-198973 | 7/1992 | Japan . |
| 07168449 | 7/1995 | Japan . |
| 08137275 | 5/1996 | Japan . |

*Primary Examiner*—Robert Beatty
*Attorney, Agent, or Firm*—Fitzpatrick, Cella, Harper & Scinto

[57] ABSTRACT

The present invention provides a developing apparatus comprising a developing container for containing magnetic developing agent, a developing agent bearing member provided at an opening portion of the developing container and adapted to bear and convey the magnetic developing agent, an internal magnet provided within the developing agent bearing member, and a magnetic seal member provided along a circumferential direction of the developing agent bearing member and adapted to prevent leakage of the developing agent at ends of the developing agent bearing member, and wherein the internal magnet and the magnetic seal member have magnetic poles of same polarities in the vicinity of a collecting inlet of the opening portion.

11 Claims, 9 Drawing Sheets

DEVELOPING APPARATUS WITH MAGNETIC SEAL

BACKGROUND OF THE INVENTION

1. Field of the Invention

The present invention relates to a developing apparatus used in image forming apparatus of electrophotographic or electrostatic recording type and adapted to develop an electrostatic latent image on an image bearing member.

2. Related Background Art

Nowadays, an image forming apparatuses of electrophotographic type have widely been used as copying machines, printers or the like, and, in such image forming apparatuses, an electrostatic latent image formed on an electrophotographic photosensitive member is developed with developing agent (referred to as "toner" hereinafter) as a toner image which is in turn transferred onto a recording medium. In a developing apparatus for effecting development with toner, as shown in FIG. 12, for example, a cylindrical developing sleeve (toner convey means) 52 having a magnet member 51 therein is rotatably attached to an opening portion of a toner container 50 containing two-component toner comprised of magnetic toner or magnetic carrier and non-magnetic toner, and the toner is transferred to an electrophotographic photosensitive member 53 by the developing sleeve.

In recent years, such a developing apparatus can detachably mounted to the image forming apparatus and such a developing method has been applied to an image forming apparatus using a process cartridge including an electrophotographic photosensitive member and a developing apparatus.

In the developing apparatus, elastic seal members 54 are attached to the developing sleeve 52 and both ends of the opening portion so that toner is prevented from leaking through the ends by the seal members 54. However, with this sealing arrangement, since the elastic seal members 54 are urged against the outer peripheral surface of the developing sleeve 52, rotational load of the developing sleeve 52 becomes great, and sealing ability may be reduced by degradation of the elastic seal members 54.

To avoid this, in case where the toner is magnetically absorbed, it is considered that magnetic sealing is achieved by a magnetic force generating means. For example, as shown in FIG. 13, at each longitudinal end of the developing sleeve 52, a magnetic seal member 55 having N and S poles arranged alternately in a rotational direction of the developing sleeve 52 is provided on a surface opposed to the developing sleeve with a predetermined gap g therebetween so that the toner is held magnetically. With this magnetic sealing arrangement, since the magnetic seal members 55 are not contacted with the developing sleeve 52, the rotational load of the developing sleeve 52 becomes small, and, since there is no degradation of the seal members due to wear, recycle of the magnetic seal members 55 is permitted.

In the above-mentioned magnetic sealing arrangement, when the gap g between the developing sleeve 52 and each magnetic seal member 55 is made smaller, the magnetic force of the magnetic seal member 55 can substantially be increased thereby to improve the sealing ability, and, thus, it is preferable. However, if the gap g is made extremely small, when the toner passed through the developing area is collected in the toner container again, scattering and leakage of toner are apt to occur.

SUMMARY OF THE INVENTION

An object of the present invention is to provide a developing apparatus in which rotational load of a developing agent bearing member is small.

Another object of the present invention is to provide a developing apparatus in which collection ability of developing agent passed through a developing area is excellent and which has good end sealing ability.

A further object of the present invention is to provide a developing apparatus comprising a developing container for containing magnetic developing agent, a developing agent bearing member provided at an opening portion of the developing container and adapted to bear and convey the magnetic developing agent, an internal magnet provided within the developing agent bearing member, and a magnetic seal member provided along a circumferential direction of the developing agent bearing member and adapted to prevent leakage of the developing agent at ends of the developing agent bearing member, and wherein the internal magnet and the magnetic seal member have magnetic poles of same polarities in the vicinity of a collecting inlet of the opening portion.

The other objects and features of the present invention will be apparent from the following detailed explanation of the invention referring to the accompanying drawings.

DETAILED DESCRIPTION OF THE PREFERRED EMBODIMENTS

The present invention will now be explained in connection with embodiments thereof with reference to the accompanying drawings.

[First Embodiment]

Figure 1:
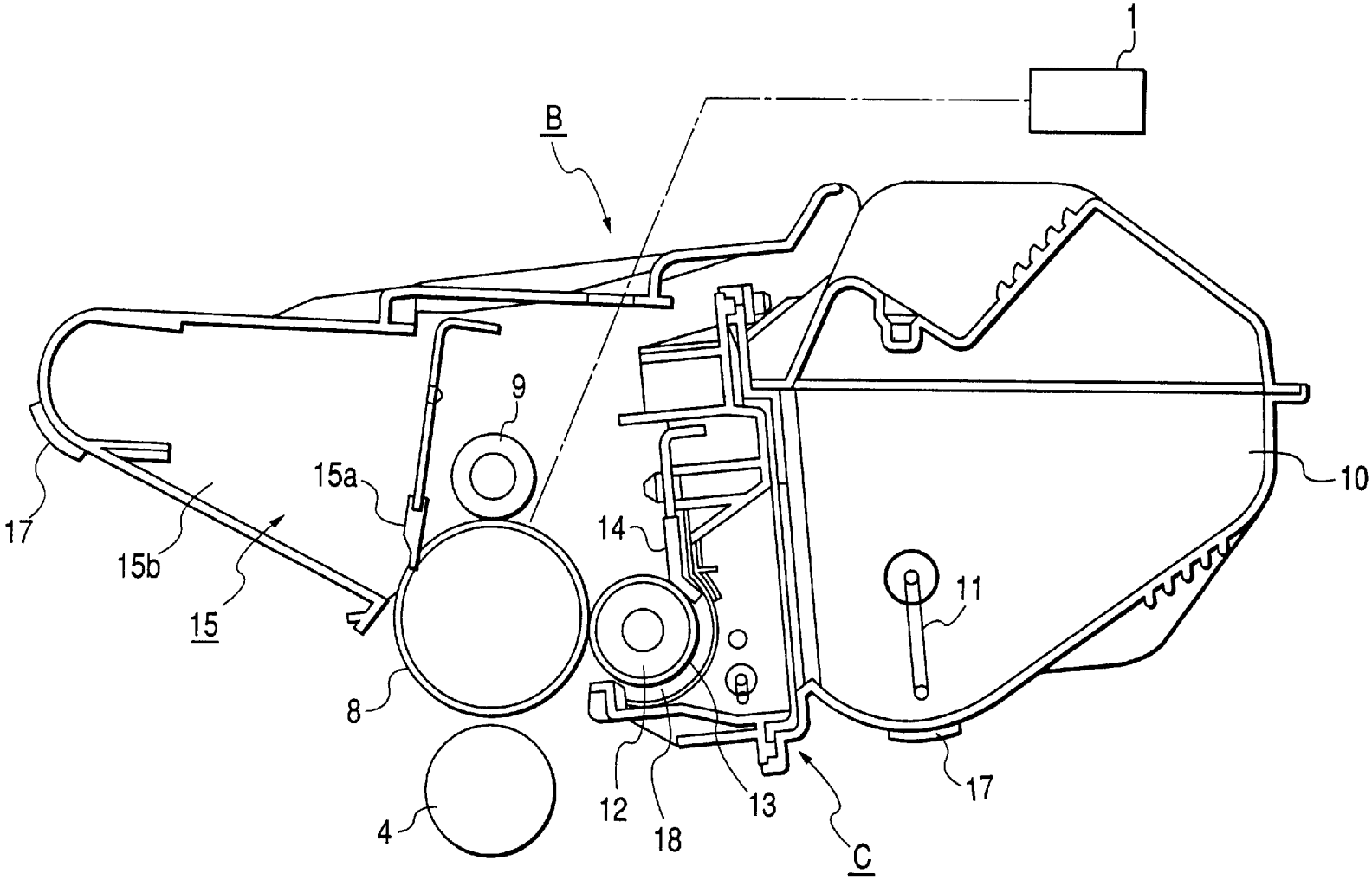
FIG. 1 is a schematic explanatory view of a process cartridge using a developing apparatus according to a first embodiment of the present invention.
Figure 3A:
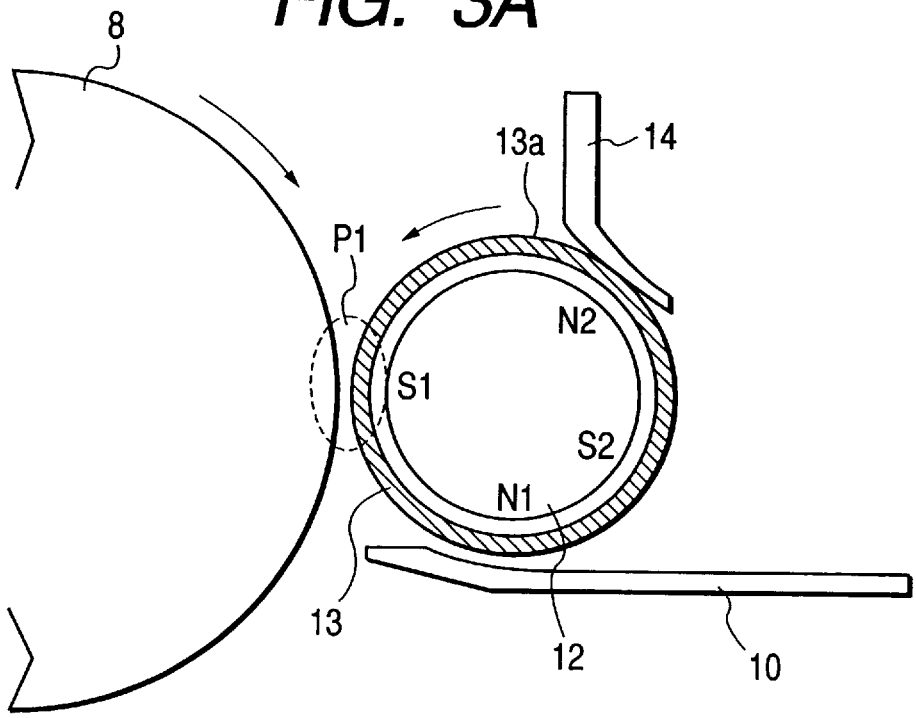
FIG. 3A is a longitudinal central sectional view of the developing apparatus.
Figure 3B:
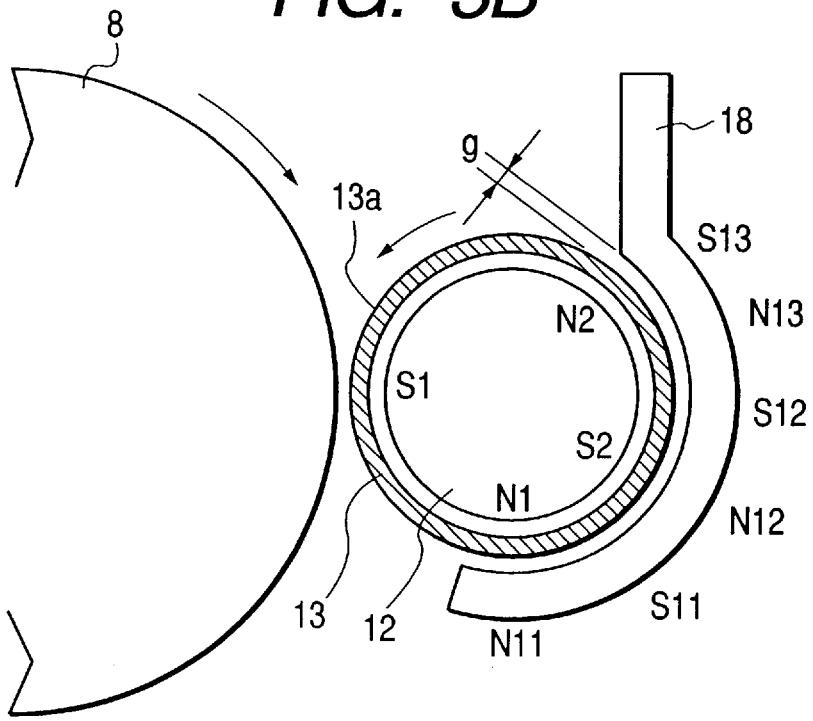
FIG. 3B is a longitudinal end sectional view of the developing apparatus.
Figure 4:
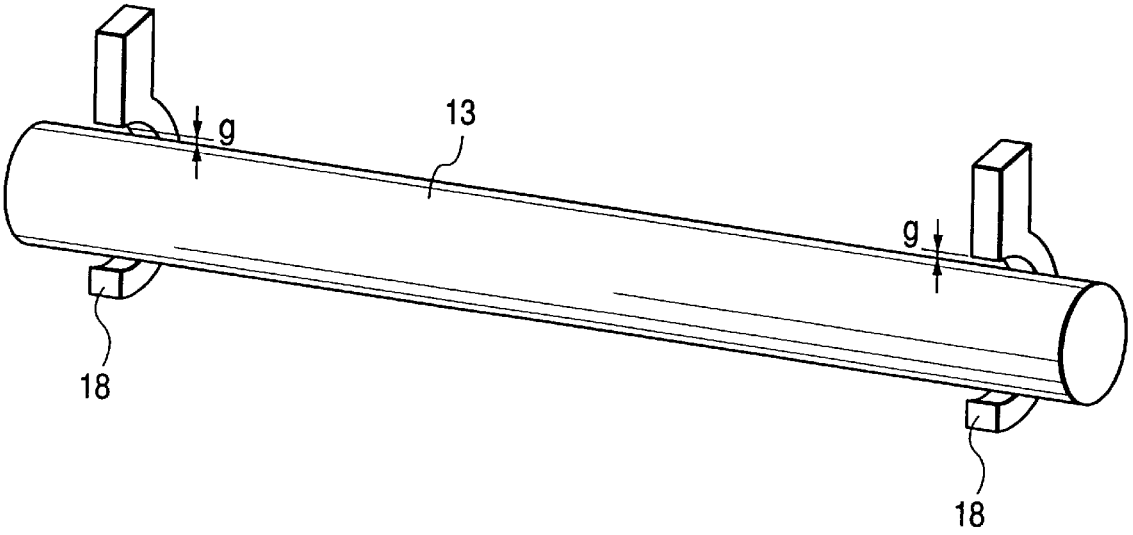
FIG. 4 is a perspective view showing a magnetic sealing arrangement.
Figure 5:
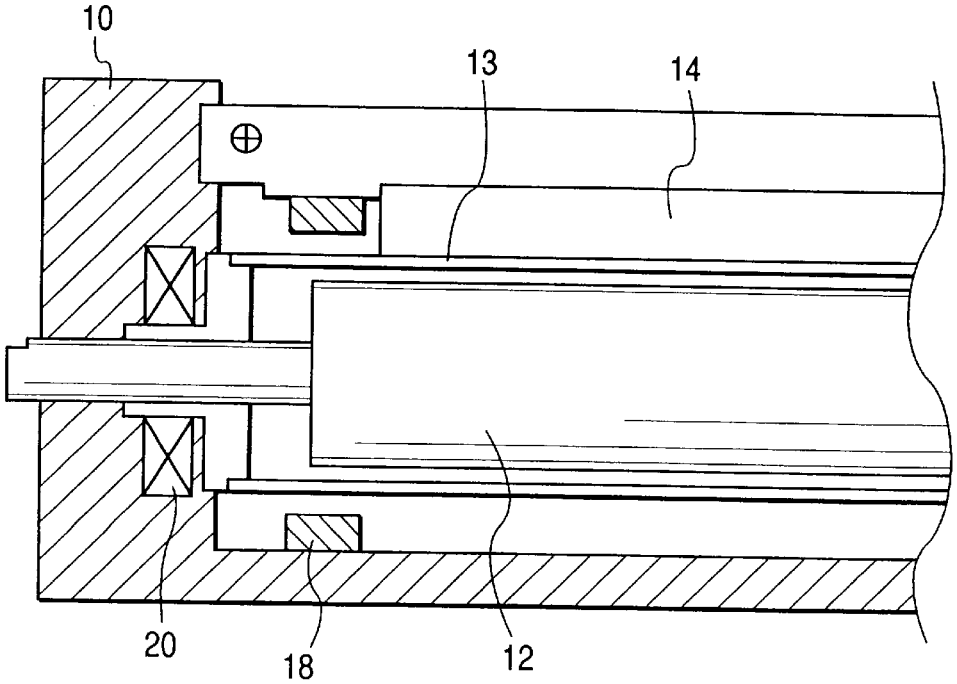
FIG. 5 is a sectional view of the sealing arrangement.
Figure 6:
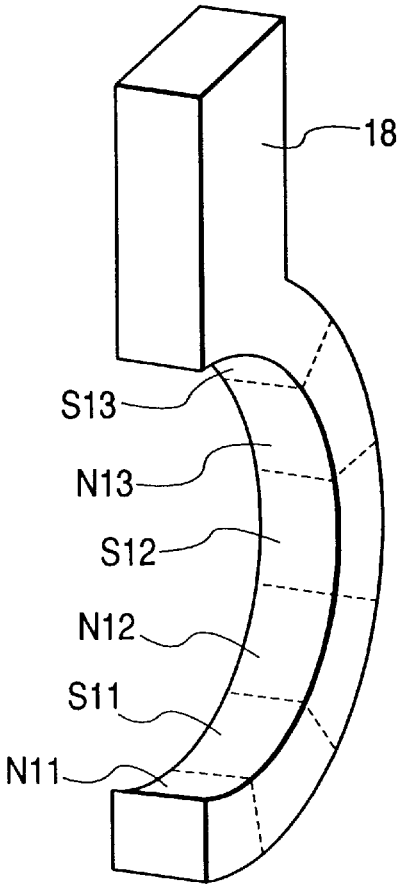
FIG. 6 is a perspective view showing a magnetic seal member.
Figure 7A:
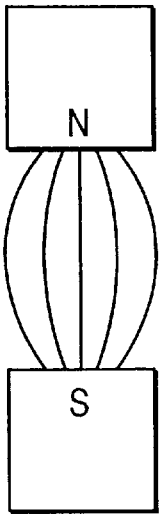
FIG. 7A is an explanatory view showing a condition of lines of magnetic force between opposite magnetic poles.
Figure 7B:
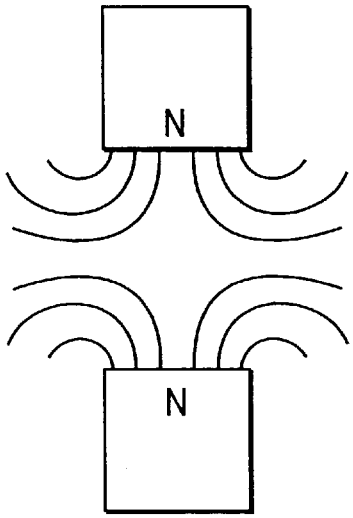
FIG. 7B is an explanatory view showing a condition of lines of magnetic force between same magnetic poles.

A first embodiment of the present invention will be explained with reference to FIGS. 1 to 6 and 7A and 7B. Incidentally, FIG. 1 is a schematic explanatory view of a process cartridge using a developing apparatus according to the first embodiment of the present invention, FIG. 2 is a schematic explanatory view of an electrophotographic image forming apparatus to which the process cartridge is mounted, FIG. 3A is a longitudinal central sectional view of the developing apparatus, FIG. 3B is a longitudinal end sectional view of the developing apparatus, FIG. 4 is a perspective view showing a magnetic sealing arrangement, FIG. 5 is a sectional view of the sealing arrangement, FIG. 6 is a perspective view showing a magnetic seal member, FIG. 7A is an explanatory view showing a condition of lines of magnetic force between opposite magnetic poles, and FIG. 7B is an explanatory view showing a condition of lines of magnetic force between same magnetic poles.

First of all, entire construction of the process cartridge and the electrophotographic image forming apparatus using the developing apparatus, and then, the magnetic sealing arrangement of the developing apparatus will be explained.

<Electrophotographic Image Forming Apparatus>

Figure 2:
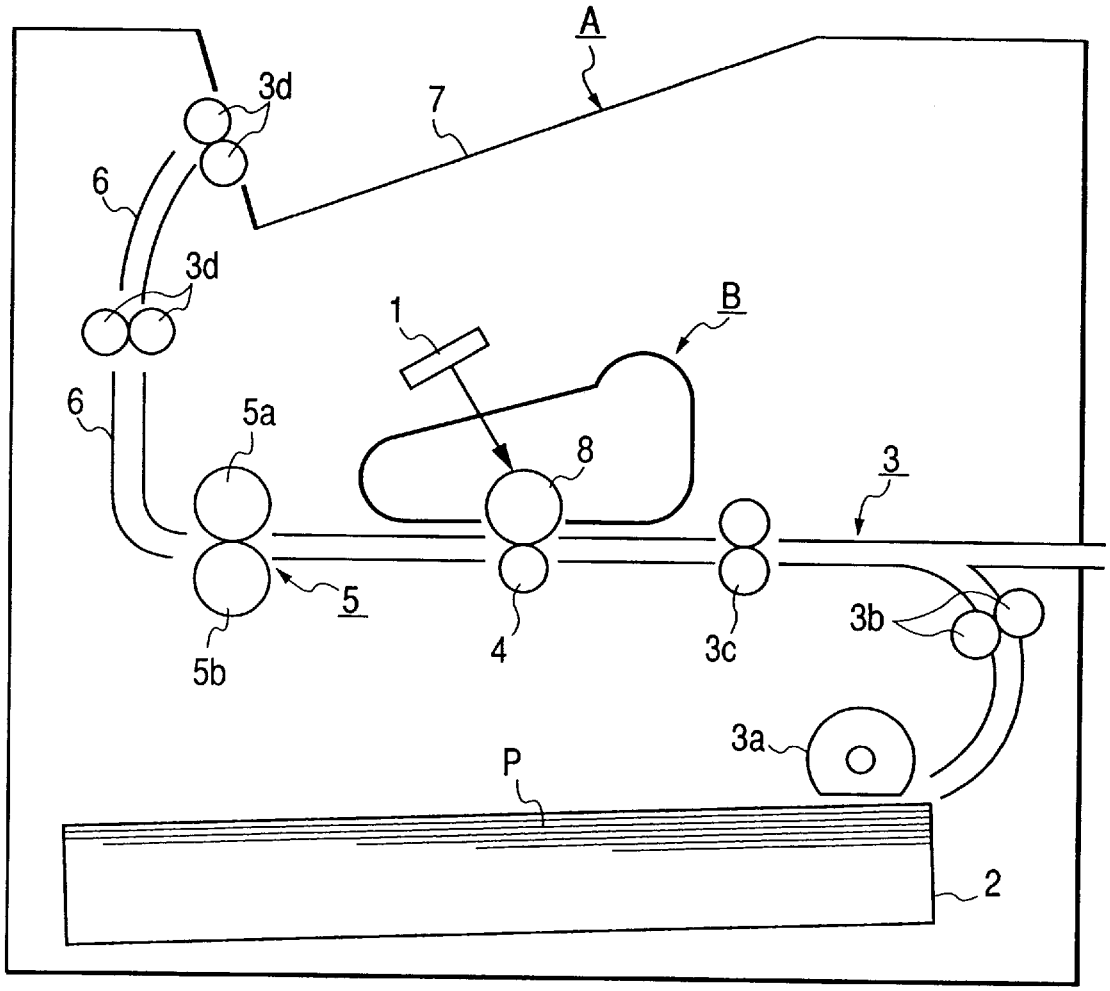
FIG. 2 is a schematic explanatory view of an electrophotographic image forming apparatus to which the process cartridge is mounted.

As shown in FIG. 2, in the electrophotographic image forming apparatus (laser beam printer) A, information light emitted from an optical system 1 and corresponding to image information is illuminated onto a drum-shaped electrophotographic photosensitive member to form a latent image on the photosensitive member, and the latent image is developed as a toner image. synchronous with the formation of the toner image, a transfer material P is conveyed from a cassette 2 by means of a convey means 3 comprised of a pick-up roller 3*a*, a convey roller 3*b* and a pair of regist rollers 3*c*. And, the toner image formed on the electrophotographic photosensitive member included in a process cartridge B is transferred onto the transfer material P by applying voltage to a transfer roller (transfer means) 4. After the image is transferred, the transfer material P is conveyed to a fixing means 5 comprised of a fixing rotary member 5*a* including a heater therein and a drive roller 5*b* for urging the transfer material P against the rotary member 5*a*, where the transferred toner image is fixed to the transfer material P. Further, the transfer material P is conveyed by a pair of discharge rollers 3*d*, so that the transfer material is discharged onto a discharge portion 7 through a reverse convey path 6.

<Process Cartridge>

On the other hand, the process cartridge B includes therein the electrophotographic photosensitive member, and at least the developing apparatus (as a process means). The process means may be, for example, a charge means for charging the electrophotographic photosensitive member, a developing apparatus for developing the latent image formed on the electrophotographic photosensitive member and a cleaning means for cleaning residual toner remaining on the electrophotographic photosensitive member.

As shown in FIG. 1, in the process cartridge according to the illustrated embodiment, while a photosensitive drum (image bearing member for bearing an electrostatic latent image) 8 having a photosensitive layer is being rotated, a surface of the photosensitive drum is uniformly charged by applying voltage to a charge roller (charge means), and, information light from the optical system 1 is illuminated on the photosensitive drum 8 through an exposure portion to expose the photosensitive drum, thereby forming a latent image, and, the latent image is developed by a developing apparatus C.

That is to say, one-component magnetic toner (developing agent) contained within a toner container 10 is sent out by a toner feed member 11. By rotating a developing sleeve (toner convey means) 13 containing a magnet roller (magnet member) 12 therein and by applying frictional charges to the toner by means of a developing blade 14, a toner layer is formed on the developing sleeve 13, thereby transferring the toner onto the latent image on the photosensitive drum 8 to visualize the latent image as a toner image.

After the toner image is transferred to the transfer material P by applying voltage having polarity opposite to that of the toner image to the transfer roller 4, residual toner remaining on the photosensitive drum 8 is removed by a cleaning means 15 in which the residual toner is scraped by a cleaning blade 15*a* and the scraped toner is collected into a cleaning container 15*b*.

Various members such as the photosensitive drum 8 are supported by a housing obtained by joining the cleaning container 15*b* to a developing container formed by welding the toner container 10 to a developing frame 16 to which the developing sleeve 13 and the developing blade 14 are attached, thereby forming the process cartridge. A cartridge mounting space is formed within the image forming apparatus. The process cartridge can be mounted to and dismounted from the cartridge mounting space through guide and support portions (cartridge mounting means) 17 provided in the cartridge mounting space.

<Developing Apparatus and Magnetic Sealing Arrangement>

Next, the developing apparatus C and a magnetic sealing arrangement for preventing the toner from leaking through gaps between an opening portion of the toner container and longitudinal ends of the developing sleeve 13 will be explained.

As shown in FIGS. 3A and 3B, in the developing apparatus C, the developing sleeve 13 is disposed at the opening portion of the toner container 10 containing the toner. The developing sleeve 13 is formed from a non-magnetic cylinder made of aluminium, stainless steel or the like and includes the fixed magnet roller 12 therein. The developing sleeve is rotatably attached to the toner container 10 via sleeve bearings 20 (FIG. 5). In the illustrated embodiment, the magnet roller 12 is provided at its surface with two N poles N1, N2 and two S poles S1, S2. The developing sleeve 13 is rotated in an anti-clockwise direction (shown by the arrow) in FIGS. 3A and 3B, so that the magnetic toner supplied from the toner container 10 is adhered to the surface of the developing sleeve by a magnetic force of the magnet roller 12. The developing blade 14 constitutes a developing agent layer thickness regulating means and is urged against the developing sleeve 13 at the outlet of the opening portion of the toner container 10 under the presence of N2 pole, thereby regulating a thickness of the toner layer which is conveyed to a developing area P1 by the developing sleeve 13.

By applying to the developing sleeve 13 vibration bias voltage obtained by overlapping DC voltage with AC voltage from a power source (not shown), at the developing area P1 (developing magnetic pole S1), the conveyed magnetic toner is transferred onto the latent image formed on the photosensitive drum 8 shifted in a direction shown by the arrow in FIGS. 3A and 3B, thereby visualizing the latent image. Incidentally, a wave form of the vibration bias voltage may be a rectangular wave, a sine wave or the like.

After the development, the magnetic toner remaining on the developing sleeve 13 is collected into the toner container 10 by the collecting pole N1 at the inlet of the toner container 10 and then is agitated and mixed with the magnetic toner within the toner container 10 through the pick-up pole S2.

Magnet seal members 18 are magnetic force generating means provided at its inner peripheral surface with a plurality of N, S poles and are disposed at both ends of the developing sleeve 13, as shown in FIGS. 4 and 5. Each magnet seal member 18 is opposed to a convey surface 13*a* of the developing sleeve 13 with a gap g therebetween and is attached to the toner container 10. In the illustrated embodiment, as shown in FIG. 6, each magnet seal member 18 has three S poles S11, S12, S13 and three N poles N11, N12, N13 formed on a surface of the member opposed to the convey surface 13*a* of the developing sleeve 13.

Since each magnet seal member 18 is provided at its surface (opposed to the sleeve) with the plurality of N, S poles, a magnet brush can be cocked under the action of a magnetic field of the magnet seal member 18. Thus, good sealing ability can be achieved, thereby effectively preventing toner escape and toner leakage due to shock.

Incidentally, since the cost is increased if the magnetic forces of the magnet seal members 18 are increased, the gap g between the surface (opposed to the sleeve) of each magnet seal member 18 and the convey surface 13*a* of the developing sleeve 13 is selected to be smaller so that the substantial magnetic force between the magnet seal member 18 and the developing sleeve 13 is increased, thereby obtaining the good sealing ability. However, if the gap g between the magnet seal member 18 and the surface of the developing sleeve 13 is very small, it may be difficult to collect the toner passed through the developing area P1 into the toner container 10.

To avoid this, in the illustrated embodiment, as shown in FIGS. 3A and 3B, at the inlet of the opening portion of the toner container, the magnetic pole (N1 pole) of the magnet roller 12 has the same polarity as that of the magnetic poles (N11 poles) of the magnet seal members 18 opposed to the magnet roller. With this arrangement, the toner passed through the developing area P1 can surely be collected into the toner container. The reason will be fully described hereinbelow.

FIGS. 7A and 7B are schematic views showing a condition of lines of magnetic force caused by the opposed magnetic poles on the magnet roller 12 and magnet seal members 18. FIG. 7A shows a case where N-S forward magnetic field is formed, and FIG. 7B shows a case where N-N repulsion magnetic field is formed. As shown in FIG. 7A, when the opposite (N-S) magnetic poles are formed, the lines of magnetic force are concentrated in the vertical direction and the toner particles are disposed along the lines of magnetic force, so that the toner is hard to be conveyed and collected due to the presence of the chain of the magnetic toner particles. However, as shown in FIG. 7B, when the N-N repulsion magnetic field is formed, the lines of magnetic force are curved, and, since the toner particles are disposed along the lines of magnetic force, there is an area having no magnetic toner chain between N-N poles, with the result that the toner is apt to be conveyed and collected through such an area.

Accordingly, with an arrangement as mentioned above, even when the gaps between the magnet seal members 18 and the surface of the developing sleeve 13 are relatively small, the toner passed through the developing area P1 can surely be collected into the toner container 10, thereby effectively preventing leakage and scattering of the toner.

Incidentally, as shown in FIGS. 3A and 3B, in the magnet seal member 18 according to the illustrated embodiment, various poles N12, S13 are arranged at positions opposed to two magnetic poles S2, N2 of the magnet roller 12 other than the collecting pole N1 disposed at the inlet of the opening portion of the toner container, with the result that N-S magnetic field is formed by cooperating with the magnet roller 12. Thus, in this area, the magnetic toner brush is formed to achieve the good sealing ability. At a portion within the toner container 10 where a large amount of toner exists, since the toner tries to shift toward both ends due to great pressure, toner escape and toner leakage due to shock are apt to occur. Accordingly, adequate sealing ability is requested at this portion and the N-S magnetic field greatly contributes to the sealing ability. On the other hand, at the opening portion of the developing apparatus, since the amount of toner is small and toner pressure is small and the toner escape and toner leakage due to shock are hard to occur, even when N-N magnetic field is formed, there is no problem regarding the sealing ability.

In general, when the developing sleeve 13 is rotated, the magnetic toner on the developing sleeve 13 tries to shift toward the longitudinal ends of the sleeve due to dispersing action. In order to prevent the toner escape at the opening portion, during the time period in which the magnetic toner supplied from the toner container 10 to the opening portion is returned to the toner container 10 again, dispersing and shifting of the toner toward the ends may be prevented. Since the amount of toner is small at the inlet of the opening portion of the toner container 10, even when the same polarity magnetic field is formed, the toner escape does not easily occur.

<Test Result>

Next, a test result obtained by using the above-mentioned developing apparatus will be described. In the illustrated embodiment, a peripheral speed of the photosensitive drum 8 was selected to 94 mm/sec, an outer diameter of the photosensitive drum was selected to 30 mm, a peripheral speed of the developing sleeve 13 was selected to 111 mm/sec and an outer diameter of the developing sleeve 13 was selected to 16 mm. A rotational direction of the developing sleeve 13 was selected to be as a normal direction with respect to the photosensitive drum 8. A gap h between the photosensitive drum 8 and the developing sleeve 13 was selected to be 0.3 mm.

In this case, it was found that a peak value of magnetic flux density (in a tangential direction with respect to the surface of the developing sleeve) on the sleeve surface regarding each magnetic pole of the magnet roller 12 fixed within the developing sleeve 12 is 400 to $900\times10^{-4}$ T (tesla). Each magnet seal member 18 was formed from a molded part having nylon binder including Nd-Fe-B magnetic powder and having a width of 4 mm. The gap g between each magnet seal member 18 and the developing sleeve 13 was selected to 0.1 to 0.7 mm.

In this case, it was found that a peak value of magnetic flux density (in a tangential direction with respect to the surface of the developing sleeve) on the sleeve surface regarding each magnetic pole of the magnet seal member 18 is 1,000 to $2{,}200\times10^{-4}$ T (tesla).

When image formation was effected on 2,000 transfer materials by using the image forming apparatus according to the illustrated embodiment, it was found that the toner is effectively collected, there is the toner leakage and toner scattering, image density is sufficiently high, there is no fog and good image can be obtained.

As mentioned above, in the developing apparatus according to the illustrated embodiment, even when the gap g between each magnet seal member 18 and the developing sleeve 13 is small such as 0.7 mm or less, the toner can be collected effectively, leakage and scattering of toner can be suppressed or prevented, sufficient image density can be achieved and good image can be obtained. Further, toner escape toward the longitudinal direction (axial direction) of the developing sleeve 13 can also be suppressed or prevented. In addition, when the process cartridge is mounted and dismounted with respect to the image forming apparatus by the operator, if any shock is applied, toner leakage does not occur. In this way, good sealing ability can be obtained.

[Second Embodiment]

Figure 8:
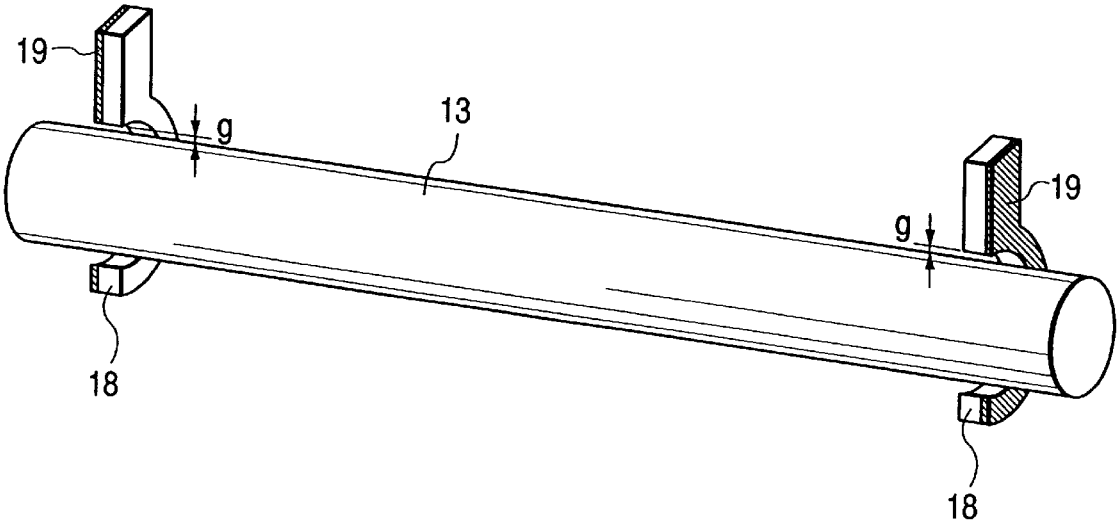
FIG. 8 is a perspective view showing a magnetic sealing arrangement of a developing apparatus according to another embodiment of the present invention in which the present invention is applied to a digital electrophotographic copying machine.
Figure 9:
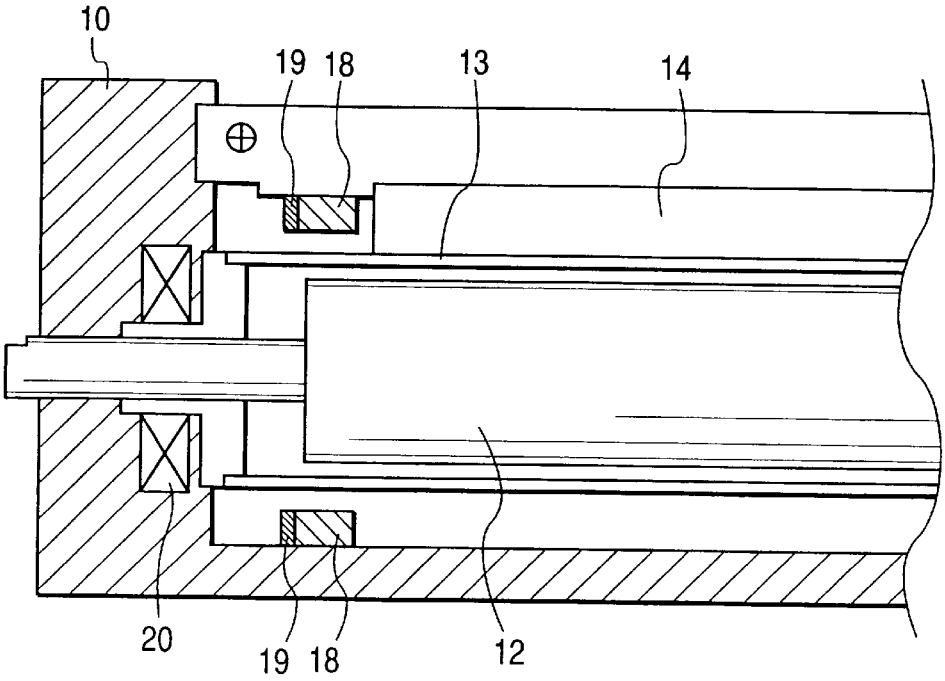
FIG. 9 is a longitudinal sectional view of a main part of the developing apparatus.

Next, a second embodiment of a magnetic sealing arrangement of a developing apparatus will be explained with reference to FIGS. 8, 9, 10A to 10D, 11A and 11B. FIG. 8 is a perspective view showing a magnetic sealing arrangement of a developing apparatus according to another embodiment of the present invention in which the present invention is applied to a digital electrophotographic copying machine, FIG. 9 is a longitudinal sectional view of a main part of the developing apparatus, FIGS. 10A to 10D and 11A and 11B are schematic views showing conditions of lines of magnetic force. Incidentally, this second embodiment differs from the first embodiment only in regard to the magnetic sealing arrangement of the developing apparatus and other arrangements are the same as those of the first embodiment. Thus, the same elements as those in the first embodiment are designated by the same reference numerals and explanation thereof will be omitted.

In the first embodiment, while an example that the magnet seal members 18 alone are disposed on both ends of the developing sleeve 13 was explained, in the second embodiment, a magnetic member 19 is disposed outside (outer side in a rotation axis direction of the developing sleeve 13) of each magnet seal member 18.

As shown in FIGS. 8 and 9, the magnet seal members 18 are disposed on both longitudinal ends of the developing sleeve 13, and the magnetic members 19 are adhered to the outer surfaces (in the width-wise direction) of the magnet seal members 18.

Next, the magnet seal members 18 and the magnetic members 19 according to the illustrated embodiment will be explained.

Each magnet seal member 18 is formed from a molded part having nylon binder including Nd-Fe-B magnetic powder and having a width of 3 mm. The magnetic member 19 has a thickness of 1 mm. The magnetic member 19 is adhered to the magnet seal member 18 by insert injection-molding. However, a both-face adhesive tape or absorption joining may be used. The gap g between the developing sleeve 13 and the magnet seal member 18 (and the magnetic member 19) was selected to 0.1 to 0.7 mm. In this case, it was found that a peak value of magnetic flux density (in a tangential direction with respect to the surface of the developing sleeve) on the sleeve surface regarding each magnetic poles of the magnet seal member 18 is 1,000 to $2,200\times10^{-4}$ T (tesla).

Figure 10A:
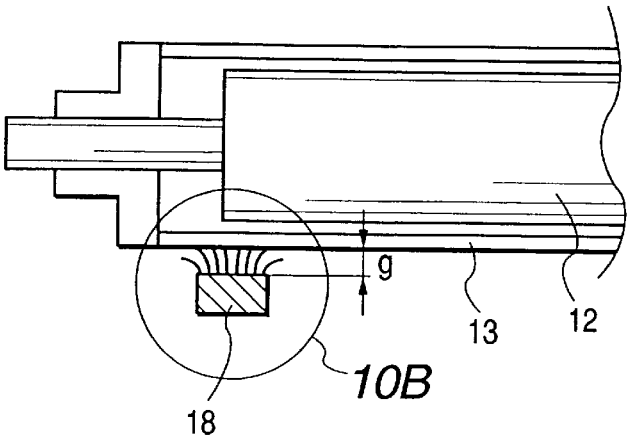
FIG. 10A is a schematic view showing a condition of lines of magnetic force when a magnet seal member alone is used.
Figure 10B:
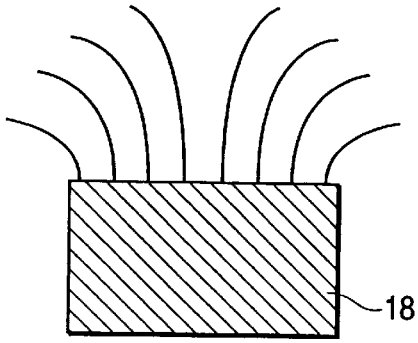
FIG. 10B is an enlarged view of a portion 10B in FIG. 10A.
Figure 10C:
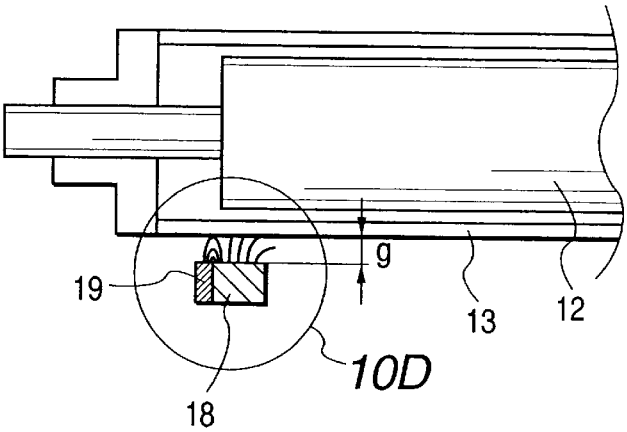
FIG. 10C is a schematic view showing a condition of lines of magnetic force when a magnetic member is provided on an outer side (end side) of a magnet seal member.
Figure 10D:
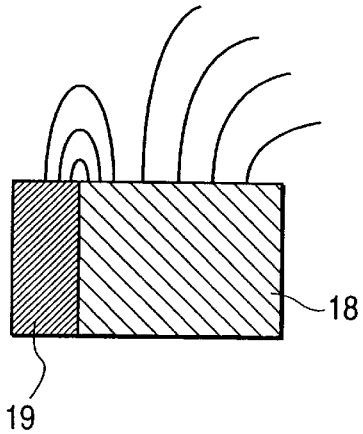
FIG. 10D is an enlarged view of a portion 10D in FIG. 10C.

FIGS. 10A to 10D are schematic views for showing a condition of lines of magnetic force. FIG. 10A shows a case where the magnet seal members 18 alone is disposed, FIG. 10B is an enlarged view of a portion 10B in FIG. 10A, FIG. 10C is a schematic view showing a condition of lines of magnetic force when the magnetic member is provided on an outer side (end side) of the magnet seal member, and FIG. 10D is an enlarged view of a portion 10D in FIG. 10C.

As shown in FIGS. 10A and 10B, when the magnet seal member alone is used, the lines of magnetic force extend in the vertical direction; whereas, as shown in FIGS. 10C and 10D, when the magnetic member is provided on an outer side (end side) of the magnet seal member, at a boundary between the magnet seal member 18 and the magnetic member 19, since the lines of magnetic force emitted from the magnet seal member 18 enter into the magnetic member 19 having higher magnetic permeability, lines of magnetic force extending out of the width of the magnet seal member 18 and the magnetic member 19 are not generated.

Accordingly, as shown in FIGS. 10C and 10D, when the magnetic member is provided on an outer side (end side) of the magnet seal member, since the magnetic toner extending along the lines of magnetic force on the surface of the magnet seal member 18 does not exist out of the magnet seal member at the magnetic member 19 side, the magnetic toner on the magnet seal member 18 does not extend out of the magnetic member 19. Thus, the magnetic toner can surely be held within a surface range of the magnet seal member 18 having the strong magnetic force, thereby suppressing or preventing the toner from escaping through the ends and preventing toner leakage due to shock.

Figure 11A:
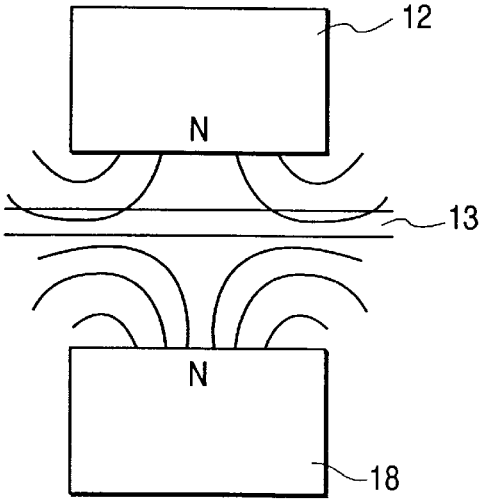
FIG. 11A is a schematic view showing a condition of lines of magnetic force in an N-N opposite magnetic field when a magnet seal member alone is used.
Figure 11B:
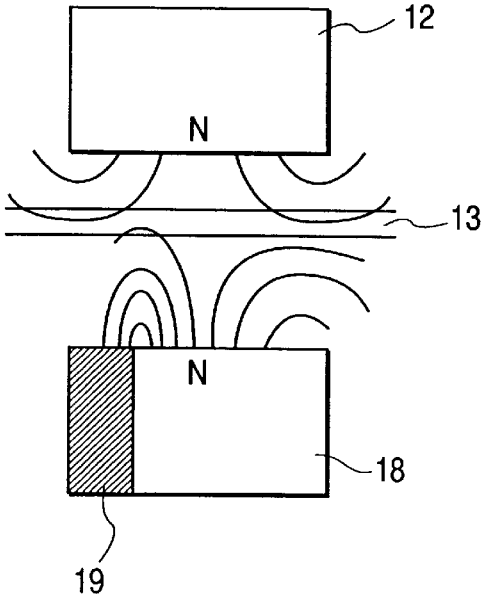
FIG. 11B is a schematic view showing a condition of lines of magnetic force in an N-N opposite magnetic field when a magnetic member is provided on an outer side (end side) of a magnet seal member.
Figure 12:
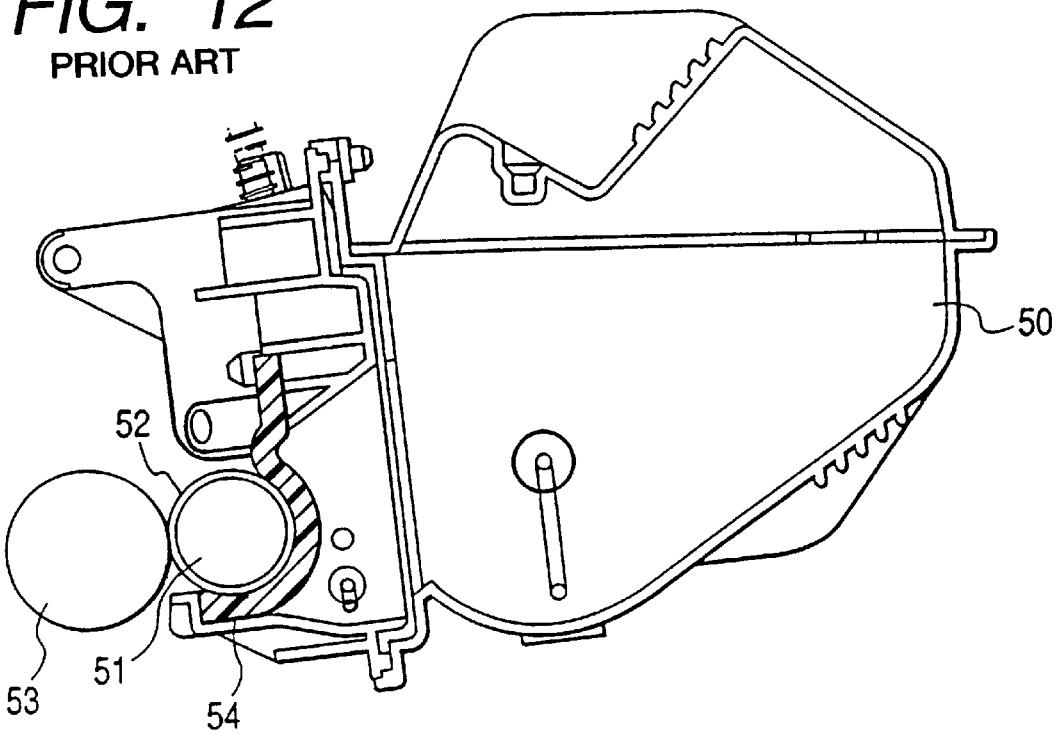
FIG. 12 PRIOR ART
FIG. 12 is an explanatory view showing an elastic sealing arrangement of the developing apparatus.
Figure 13:
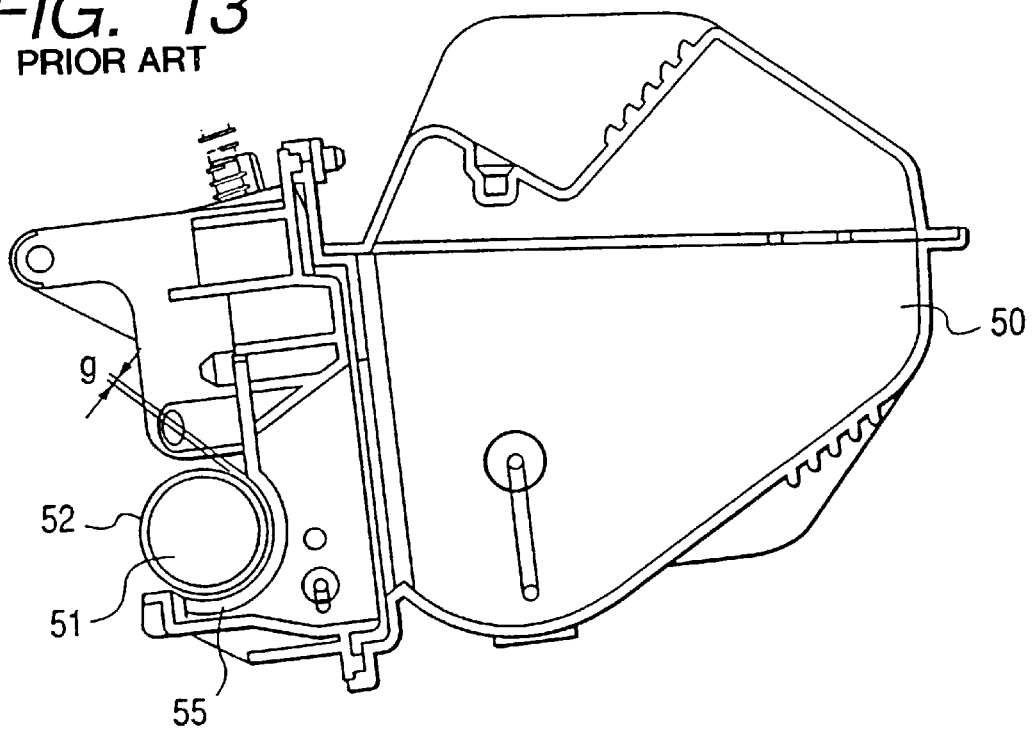
FIG. 13 PRIOR ART
FIG. 13 is an explanatory view showing a magnetic sealing arrangement of the developing apparatus.

In the arrangement using the magnetic members 19, when the magnetic poles of the magnet seal member 18 and of the magnet roller 12 are the same and are opposed to each other, the toner escape through the ends can be suppressed or prevented more effectively. The reason will be explained with reference to FIGS. 11A and 11B. FIGS. 11A and 11B are schematic views showing a condition of lines of magnetic force in case where N-N repulsion magnetic field is formed. FIG. 11A shows a case where the magnet seal members 18 alone is disposed, and FIG. 11B is a schematic view showing a condition of lines of magnetic force when the magnetic member is provided on an outer side (end side) of the magnet seal member.

As shown in FIG. 11A, when the magnet seal member alone is used, the lines of magnetic force are bent in a horizontal direction between the magnet seal member 18 and the magnet roller 12, and, at the position of the surface of the developing sleeve 13, the lines of magnetic force extend in parallel with the developing sleeve 13. Since the magnetic toner is disposed along such lines of magnetic force, the toner is apt to escape through the ends of the sleeve. However, as shown in FIG. 11B, when the magnetic member is provided on an outer side (end side) of the magnet seal member, since the lines of magnetic force emitted from the magnet seal member 18 enter into the magnetic member 19 having higher magnetic permeability, the lines of magnetic force are deflected toward the vertical direction at the boundary between the magnet seal member 18 and the magnetic member 19, and, since the magnetic toner is disposed along such lines of magnetic force, the magnetic toner chain is formed, the toner escape through the ends can be suppressed or prevented.

When image formation was effected on 15,000 transfer materials by using the image forming apparatus according to the illustrated embodiment in the same condition as the first embodiment, it was found that the toner is effectively collected, there is the toner leakage and toner scattering, image density is sufficiently high, there is no fog and good image can be obtained. Further, there was no toner escape through the longitudinal direction of the developing sleeve.

In this way, according to the second embodiment, in addition to the advantage of the first embodiment, the toner escape can be suppressed or prevented even when a large number of copies (15,000 sheets) are formed.

[Other Embodiments]

In the above-mentioned embodiments, while an example that the magnetic toner is used was explained, two-component developing agent comprised of non-magnetic toner and magnetic particles (carrier) may be used with same advantage.

Further, in the above-mentioned embodiments, while an example that the developing apparatus is incorporated into the process cartridge together with the photosensitive drum was explained, the present invention may be applied to an image forming apparatus in which the developing apparatus and the photosensitive drum are directly attached to a frame of the image forming apparatus. In particular, in image forming apparatus which can be transported by the user such as compact copying machines and printers, even if any shock is erroneously applied, the toner can surely be prevented from leaking from the developing apparatus by the magnetic sealing arrangement.

In the above-mentioned embodiments, while an example that the laser beam printer is used as the image forming apparatus was explained, the present invention is not limited to such an example, but the present invention can be applied to other image forming apparatus such as electrophotographic copying machines, facsimiles and the like.

While the present invention was explained with respect to embodiments thereof, various alterations can made within the scope of the invention.

What is claimed is:

1. A developing apparatus comprising:

a developing container for containing a magnetic developing agent;

a developing agent bearing member provided at an opening portion of said developing container to bear and convey the magnetic developing agent;

an internal magnet provided within said developing agent bearing member; and a magnetic seal member provided, in such a manner that said magnetic seal member is opposed to a surface of said developing agent bearing member, along a circumferential direction of said developing agent bearing member to prevent leakage of the developing agent at ends of said developing agent bearing member by, forming a magnetic field between said internal magnet and said magnetic seal member;

wherein said internal magnet and said magnetic seal member respectively have magnetic poles of same polarities to each other in the vicinity of a developing agent inlet of said magnetic seal member in a developing agent carrying direction.

2. A developing apparatus according to claim 1, wherein the magnetic pole of said internal magnet and the magnetic pole of said magnetic seal member in the vicinity of the developing agent inlet are substantially opposed to each other.

3. A developing apparatus according to claim 1, wherein said internal magnet has a magnetic pole at a position opposed to said magnetic seal member, as well as the magnetic pole disposed in the vicinity of the developing agent inlet.

4. A developing apparatus according to claim 3, wherein said magnetic seal member has magnetic poles at positions substantially opposed to the magnetic poles of said internal magnet, and the magnetic poles of said magnetic seal member have polarities opposite to those of said internal magnet, except for the magnetic pole disposed in the vicinity of the developing agent inlet.

5. A developing apparatus according to claim 4, wherein the number of magnetic poles of said magnetic seal member is greater than that of said internal magnet.

6. A developing apparatus according to claim 1, wherein the developing agent is one-component magnetic toner.

7. A developing apparatus according to claim 1, wherein said magnetic seal member comprises a magnet having a plurality of magnetic poles, and a magnetic metal plate disposed adjacent to said magnet.

8. A developing apparatus according to claim 7, wherein said magnetic metal plate is made of iron.

9. A developing apparatus according to claim 1, wherein said developing apparatus is formed as a process cartridge together with an image bearing member for bearing an electrostatic latent image.

10. A developing apparatus according to claim 1, wherein the developing agent inlet is provided in the vicinity of a developing agent collecting inlet of the opening portion.

11. A developing apparatus according to claim 1, wherein said developing agent bearing member has a cylinder shape and said magnetic seal member has an arc shape portion.

* * * * *

UNITED STATES PATENT AND TRADEMARK OFFICE

CERTIFICATE OF CORRECTION

PATENT NO. : 6,029,030

DATED : February 22, 2000

INVENTOR(S) : MASAAKI YAMAJI, ET AL.

It is certified that error appears in the above-identified patent and that said Letters Patent is hereby corrected as shown below:

COLUMN 1
Line 10, "an" should be deleted; and
Line 25, "can" should read --can be--.

COLUMN 7
Line 66, "members" should read --member--.

Signed and Sealed this

Tenth Day of April, 2001

*Attest:*

Nicholas P. Godici

NICHOLAS P. GODICI

*Attesting Officer*

*Acting Director of the United States Patent and Trademark Office*